US006696911B2

(12) United States Patent
Tomohiro et al.

(10) Patent No.: US 6,696,911 B2
(45) Date of Patent: Feb. 24, 2004

(54) MULTILAYERED COMMON-MODE CHOKE COIL

(75) Inventors: Takashi Tomohiro, Omihachiman (JP); Hiromichi Tokuda, Omihachiman (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 10/233,491

(22) Filed: Sep. 4, 2002

(65) Prior Publication Data

US 2003/0052766 A1 Mar. 20, 2003

(30) Foreign Application Priority Data

Sep. 5, 2001 (JP) ..... 2001-269447

(51) Int. Cl.[7] ..... H01F 5/00
(52) U.S. Cl. ..... 336/200; 336/83
(58) Field of Search ..... 336/65, 83, 192, 336/200, 222, 223, 232; 29/602.1, 605–607

(56) References Cited

U.S. PATENT DOCUMENTS 6,384,705 B1 * 5/2002 Huang et al. ..... 336/200

FOREIGN PATENT DOCUMENTS

| | | | |
|---|---|---|---|
| JP | 03-219609 | * | 9/1991 |
| JP | 04-142715 | * | 5/1992 |
| JP | 04-364709 | * | 12/1992 |
| JP | 2001-44033 | * | 2/2001 |

* cited by examiner

*Primary Examiner*—Tuyen T. Nguyen
(74) *Attorney, Agent, or Firm*—Keating & Bennett, LLP

(57) ABSTRACT

A common-mode choke coil includes first to third spiral coils, in which the diameters of coil portions are substantially the same and the axes of the coil portions are aligned collinearly. Extended portions of the first and second coils have a flectional pattern and connect coil portions located at substantially the center in the longitudinal direction of sheets and input/output electrodes. The junctions of the extended portions and the coil portions have a folded configuration. Accordingly, the number of turns and the line length of the first coil are the same as those of the second coil.

16 Claims, 7 Drawing Sheets

MULTILAYERED COMMON-MODE CHOKE COIL

BACKGROUND OF THE INVENTION

1. Field of the Invention

The present invention relates to multilayered common-mode choke coils, for example, common-mode choke coils for use with a sound signal.

2. Description of the Related Art

A conventional multilayered common-mode choke coil 60 shown in FIG. 8 has been known as a common-mode choke coil which prevents noise having the same phase from passing. The common-mode choke coil 60 includes a plurality of coils in which the diameters of coil portions are substantially equal to each other and the axes of the coil portions are aligned collinearly. The multilayered common-mode choke coil 60 includes insulating sheets 61 having surfaces that are provided with coil conductors 62 to 69, respectively.

The coil conductors 62 to 65 are electrically connected in series through via-holes 75*a* to 75*c* provided in some of the insulating sheets 61 so as to define a spiral coil La having an axis which is parallel to the laminating direction of the insulating sheets 61. The coil conductors 66 to 69 are electrically connected in series through via-holes 75*d* to 75*f* provided in some of the other insulating sheets 61 so as to define a spiral coil Lb having an axis which is parallel to the laminating direction of the insulating sheets 61.

The coil conductor 62 has an extended portion 62*a*, which is exposed at the left on the back portion of one of the sheets 61 and which functions as the input-side extended portion of the coil La. The coil conductor 65 has an extended portion 65*a*, which is exposed at the left on the front portion of one of the sheets 61 and which functions as the output-side extended portion of the coil La. Furthermore, a coil portion 62*b* of the coil conductor 62, the coil conductors 63 and 64, and a coil portion 65*b* of the coil conductor 65 are spirally wound by 1.75 turns so as to define a coil portion 70 of the coil La.

On the other hand, the coil conductor 69 has an extended portion 69*a*, which is exposed at the right on the back portion of one of the sheets 61 and which functions as the input-side extended portion of the coil Lb. The coil conductor 66 has an extended portion 66*a*, which is exposed at the right on the front portion of one of the sheets 61 and which functions as the output-side extended portion of the coil Lb. Furthermore, a coil portion 66*b* of the coil conductor 66, the coil conductors 67 and 68, and a coil portion 69*b* of the coil conductor 69 are spirally wound by 2.25 turns so as to define a coil portion 71 of the coil Lb.

Each of the sheets 61 is laminated and then is integrally baked so that a laminated body 80 as shown in FIG. 9 is produced. An input electrode 81*a* of the coil La and an input electrode 82*a* of the coil Lb are located on the back surface of the laminated body 80, and an output electrode 81*b* of the coil La and an output electrode 82*b* of the coil Lb are located on the front surface of the laminated body 80.

As shown in FIG. 10, the input-side extended portion 62*a* of the coil La is electrically connected to the input electrode 81*a* and the output-side extended portion 65*a* is electrically connected to the output electrode 81*b*. Also, the input-side extended portion 69*a* of the coil Lb is electrically connected to the input electrode 82*a* and the output-side extended portion 66*a* is electrically connected to the output electrode 82*b*. The extended portions 62*a*, 65*a*, 66*a*, and 69*a* connect the input/output electrodes 81*a* to 82*b* and the coil portions 70 and 71 linearly with the shortest distance.

In the known common-mode choke coil 60, a 0.5-turn difference is inevitably caused between the two spiral coils La and Lb. Therefore, the line length of the coil La is different from that of the coil Lb, and thus difference in transmission delay is generated between the coils La and Lb. Consequently, a problem arises, that is, the suppression characteristic of an in-phase signal (in-phase suppression characteristic) is poor. Accordingly, the known common-mode choke coil 60 has been used only for a signal transmission line or a power supply line for a signal in a low frequency band, in which the difference in transmission delay between the coils La and Lb can be ignored.

Recently, however, difference in the number of coil turns cannot be ignored because a transmission signal of higher frequency has been used and a differential signal transmission method has been adopted. For example, in the differential signal transmission method, transmission delay is caused in accordance with the difference in the number of coil turns (difference in the length of transmission line of coils). Also, the balance of differential signal transmission is lost.

SUMMARY OF THE INVENTION

In order to solve the problems described above, preferred embodiments of the present invention provide a multilayered common-mode choke coil in which transmission delay is prevented from occurring in a high-frequency band and a balance of a transmission signal is not lost in differential signal transmission.

According to a preferred embodiment of the present invention, a multilayered common-mode choke coil includes a laminated body having a plurality of insulating layers and a plurality of coil conductors laminated together, and at least two spiral coils which are defined by electrically connecting the coil conductors and which includes extended portions and coil portions. The diameters of the coil portions of the at least two spiral coils are substantially the same, the axes of the coil portions are aligned collinearly, and the two spiral coils are aligned in the laminating direction of the insulating layers. The extended portions of the spiral coils are extended on the insulating layers and junctions of the extended portions and the coil portions are located at substantially the center in a predetermined direction of the insulating layers so that the lengths of the coil portions of the spiral coils are substantially equal to each other.

According to another preferred embodiment of the present invention, a multilayered common-mode choke coil includes a laminated body having a plurality of insulating layers and a plurality of coil conductors laminated together, and three spiral coils which are defined by electrically connecting the coil conductors and which includes extended portions and coil portions. The diameters of the coil portions of the three spiral coils are substantially the same, the axes of the coil portions are aligned collinearly, and the three spiral coils are aligned in the laminating direction of the insulating layers. Each of the three spiral coils preferably has a trifiler configuration. A spiral coil positioned at the approximate center in the laminating direction of the insulating layers is connected to a ground electrode. In two spiral coils positioned at the top and the bottom in the laminating direction of the insulating layers, the extended portions of the spiral coils are extended on the insulating layers and junctions of the extended portions and the coil portions are located at substantially the center in a predetermined direction of the insulating layers so that the lengths of the coil portions of the two spiral coils are substantially equal to each other.

With this arrangement, the junction of each of the extended portions and each of the coil portions of the spiral coils may have a folded configuration. Also, the number of turns and the line length of the spiral coils are substantially equal so that a difference in delay of signal transmission between the coils can be prevented.

Preferably, when the laminated body is seen through, the junctions of the extended portions and the coil portions of the plurality of spiral coils do not overlap. With this arrangement, a local internal stress caused at the junctions of the extended portions and the coil portions is dispersed when the laminated body, which is constructed by laminating the insulating layers and the coil conductors, is baked. Thus, breaking and cracking of the laminated body is reliably prevented when the laminated body is baked.

Further, the plurality of spiral coils are constructed by electrically connecting the plurality of coil conductors through via-holes provided in the insulating layers, and, when the laminated body is seen through, via-holes connected to the coil conductors having input-side extended portions are located at the same position and via-holes connected to the coil conductors having output-side extended portions are located at the same position. With this arrangement, the pattern shapes of the coil conductors defining the coil portions of the spiral coils and the laminating order may be the same, except for the coil conductors which have the extended portion. Accordingly, the types of patterns of the coil conductor decrease and manufacturing efficiency of the multilayered common-mode choke coil is greatly improved so that the manufacturing cost can be remarkably reduced.

Other features, elements, characteristics and advantages of the present invention will become more apparent from the following detailed description of preferred embodiments thereof with reference to the attached drawings.

DETAILED DESCRIPTION OF PREFERRED EMBODIMENTS

Hereinafter, preferred embodiments of a multilayered common-mode choke coil according to the present invention will be described with reference to the drawings.

Figure 1:
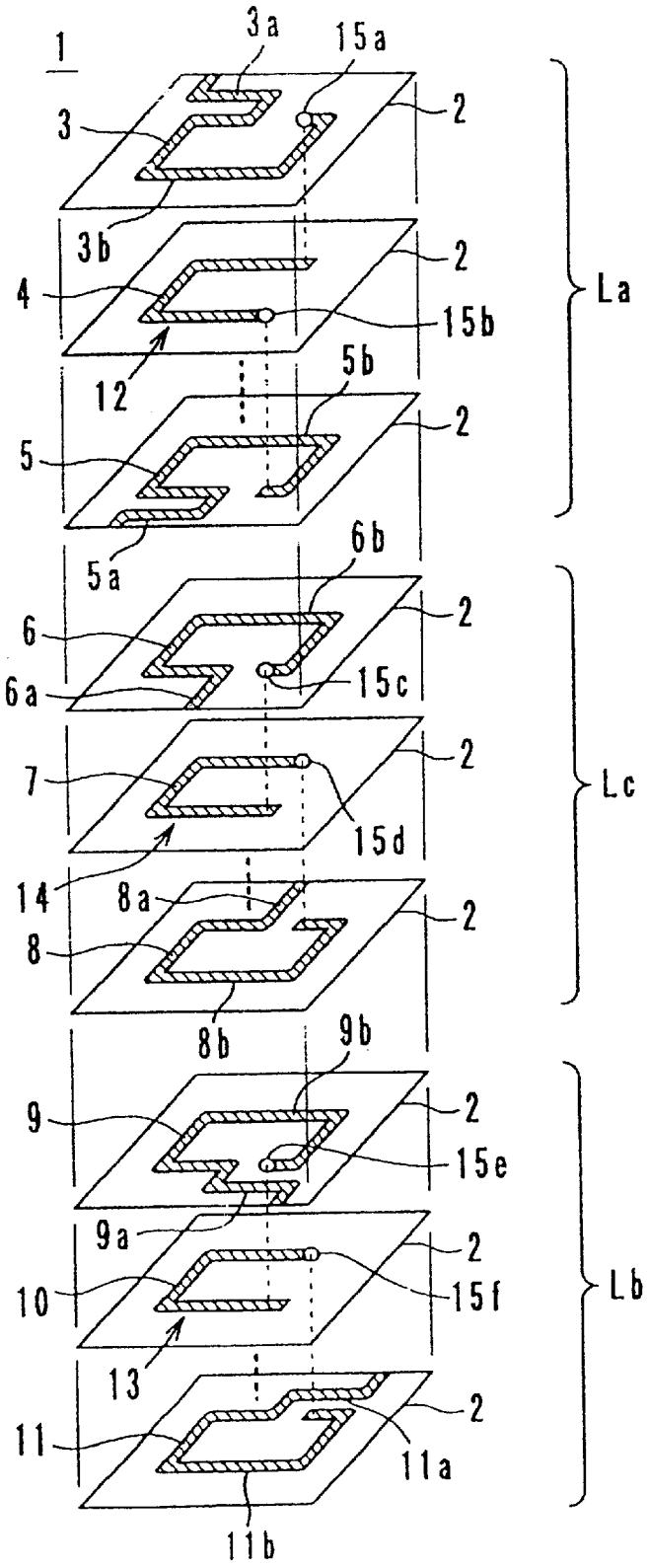
FIG. 1 is an exploded perspective view showing the configuration of a first preferred embodiment of a multilayered common-mode choke coil according to the present invention.

As shown in FIG. 1, a multilayered common-mode choke coil 1 includes insulating sheets 2 and coil conductors 3 to 11 provided on surfaces of the insulating sheets 2. The insulating sheets 2 are preferably formed by mixing dielectric ceramic powder or magnetic ceramic powder with binder or other suitable material and forming the mixture into sheets. The coil conductors 3 to 11 preferably include at least one of Ag, Pd, Cu, Ni, Au, and Ag—Pd, and are preferably formed by such methods as printing, spattering, evaporation, or photolithography, or other suitable process.

The coil conductors 3 to 5 are electrically connected in series through via-holes 15*a* and 15*b* provided in some of the insulating sheets 2 so as to define a spiral coil La having an axis which is substantially parallel to the laminating direction of the insulating sheets 2. The coil conductors 9 to 11 are electrically connected in series through via-holes 15*e* and 15*f* provided in some of the other insulating sheets 2 so as to define a spiral coil Lb having an axis which is substantially parallel to the laminating direction of the insulating sheets 2. The coil conductors 6 to 8 are electrically connected in series through via-holes 15*c* and 15*d* provided in some other insulating sheets 2 so as to define a spiral coil Lc having an axis which is substantially parallel to the laminating direction of the insulating sheets 2. Each of the spiral coils La to Lc has a trifiler configuration. Also, the coils La to Lc are laminated in the order of La, Lc, and Lb from above in the laminating direction of the insulating sheets 2.

The coil conductor 3 includes an extended portion 3*a* and a coil portion 3*b*. The extended portion 3*a* extends substantially parallel to the back of one of the sheets 2. One end of the extended portion 3*a* is exposed at the left on the back of the sheet 2 and functions as an input-side extended portion of the coil La. The other end of the extended portion 3*a* is connected to the coil portion 3*b* at substantially the center on the back of the sheet 2. Also, the coil conductor 5 includes an extended portion 5*a* and a coil portion 5*b*. The extended portion 5*a* extends substantially parallel to the front of one of the sheets 2. One end of the extended portion 5*a* is exposed at the left on the front of the sheet 2 and functions as an output-side extended portion of the coil La. The other end of the extended portion 5*a* is connected to the coil portion 5*b* at substantially the center on the front of the sheet 2. Further, the coil portion 3*b* of the coil conductor 3, coil conductor 4, and the coil portion 5*b* of the coil conductor 5 are spirally wound by a predetermined number of times so as to define a coil portion 12 of the coil La.

The coil conductor 9 includes an extended portion 9*a* and a coil portion 9*b*. The extended portion 9*a* extends substantially parallel to the front of one of the sheets 2. One end of the extended portion 9*a* is exposed at the right on the front of the sheet 2 and functions as an output-side extended portion of the coil Lb. The other end of the extended portion 9*a* is connected to the coil portion 9*b* at substantially the center on the front of the sheet 2. Also, the coil conductor 11 includes an extended portion 11*a* and a coil portion 11*b*. The extended portion 11*a* extends substantially parallel to the back of one of the sheets 2. One end of the extended portion 11*a* is exposed at the right on the back of the sheet 2 and functions as an input-side extended portion of the coil Lb. The other end of the extended portion 11*a* is connected to the coil portion 11*b* at substantially the center on the back of the sheet 2. Further, the coil portion 9*b* of the coil conductor 9, the coil-conductor 10, and the coil portion 11*b* of the coil conductor 11 are spirally wound by a predetermined number of times so as to define a coil portion 13 of the coil Lb.

The coil conductor 6 includes an extended portion 6*a* and a coil portion 6*b*. One end of the extended portion 6*a* is exposed at the approximate center on the front of one of the sheets 2 and functions as an extended portion of the coil Lc. Also, the coil conductor 8 includes an extended portion 8*a* and a coil portion 8*b*. One end of the extended portion 8*a* is exposed at the approximate center on the back of one of the sheets 2 and functions as an extended portion of the coil Lc. Further, the coil portion 6*b* of the coil conductor 6, the coil conductor 7, and the coil portion 8*b* of the coil conductor 8 are spirally wound by a predetermined number of times so as to define a coil portion 14 of the coil Lc.

Figure 2:
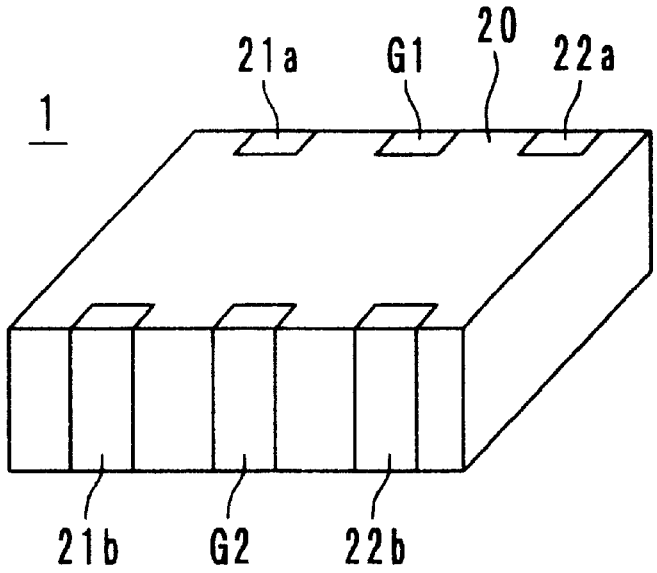
FIG. 2 is a perspective view of the multilayered common-mode choke coil shown in FIG. 1.

Each of the insulating sheets 2 is laminated, a protective insulating sheet is located on the upper and lower surfaces of each of the insulating sheets 2, and then the laminated sheets 2 are integrally baked. Accordingly, a laminated body 20 shown in FIG. 2 is produced. An input electrode 21*a* of the coil La, an input electrode 22*a* of the coil Lb, and a ground electrode G1 of the coil Lc are provided on the back surface of the laminated body 20. Also, an output electrode 21*b* of the coil La, an output electrode 22*b* of the coil Lb, and a ground electrode G2 of the coil Lc are provided on the front surface of the laminating body 20.

Figure 3:
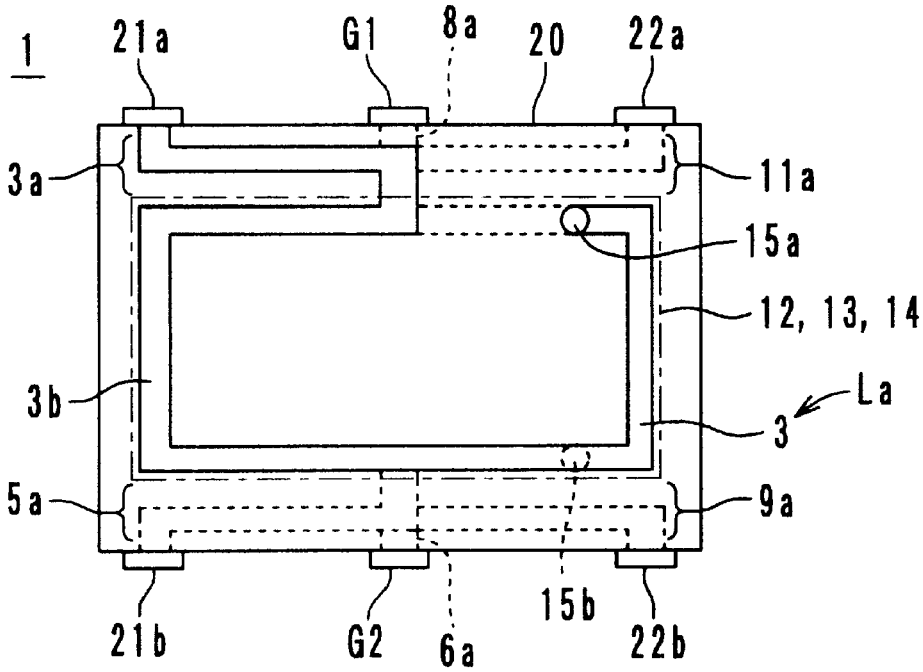
FIG. 3 is a perspective plan view of the multilayered common-mode choke coil shown in FIG. 2.

As shown in FIG. 3, the input-side extended portion 3*a* of the coil La is electrically connected to the input electrode 21*a* and the output-side extended portion 5*a* is electrically connected to the output electrode 21*b*. The input-side extended portion 11*a* of the coil Lb is electrically connected to the input electrode 22*a* and the output-side extended portion 9*a* is electrically connected to the output electrode 22*b*. The extended portions 8*a* and 6*a* of the coil Lc are electrically connected to the ground electrodes G1 and G2, respectively.

The multilayered common-mode choke coil 1 obtained in this way includes the spiral coils La to Lc, in which the diameters of the coil portions 12 to 14 are substantially equal to each other and the axes of the coil portions 12 to 14 are aligned collinearly. The spiral coils La to Lc are aligned in the laminating direction of the insulating sheets 2. Further, the magnetic coupling among the coils La, Lb, and Lc is increased by aligning the axes of the coils La to Lc. Among the three coils La to Lc, the coil Lc functions as a feedback line for a signal transmitting through the coils La and Lb.

The extended portions 3*a*, 5*a*, 9*a*, and 11*a* of the coils La and Lb are configured to have a flectional pattern (crank pattern)-having two flections, and connect the coil portions 3*b*, 5*b*, 9*b*, and 11*b*, which are located at substantially the center in the longitudinal direction of the sheets 2, and the input/output electrodes 21*a*, 21*b*, 22*b*, and 22*a*, respectively. Also, the junction of the extended portion 3*a* and the coil portion 3*b* and the junction of the extended portion 5*a* and the coil portion 5*b* have a folded configuration. Accordingly, the number of turns and the line length of the coil La are substantially equal to those of the coil Lb so that a difference in delay of signal transmission between the coils La and Lb is reduced. As a result, transmission delay is less likely to occur in a high-frequency band. For example, a balance of a transmission signal in a differential signal transmission used in a sound signal can be greatly improved.

On the other hand, the extended portions 6*a* and 8*a* of the coil Lc linearly connect the ground electrodes G1 and G2 and the coil portion 14 by the shortest distance. The coil Lc simply functions as a feedback line, and thus the line length thereof does not need to be the same as that of the coils La and Lb. Accordingly, the extended portions 6*a* and 8*a* may be linearly connected to the coil portion 14.

Furthermore, in the first preferred embodiment, when the laminated body 20 is seen through, the via-holes 15*a*, 15*f*, and 15*d* connected to the coil conductors 3, 11, and 8 having the input-side extended portions 3*a*, 11*a*, and 8*a* of the coils La, Lb, and Lc, respectively, are located at the same position. Also, the via-holes 15*b*, 15*e*, and 15*c* connected to the coil conductors 5, 9, and 6 having the output-side extended portions 5*a*, 9*a*, and 6*a*, respectively, are located at the same position. Accordingly, the pattern shapes of the coil conductors 4, 10, and 7 defining the coil portions 12 to 14 of the spiral coils La to Lc, respectively, and the laminating order of the insulating sheets 2 on which the coil conductors 4, 10, and 7 are disposed may be the same, except for the coil conductors 3, 5, 6, 8, 9, and 11, which have the extended portion. Therefore, the number steps of manufacturing the multilayered common-mode choke coil can be greatly reduced so that the manufacturing cost are significantly reduced.

Incidentally, the spiral coil Lc is not necessarily located at the approximate center in the laminating direction. That is, the spiral coil Lc may be located at the top or the bottom. Also, the diameters of the spiral coils La, Lb, and Lc need not be the same.

Figure 4:
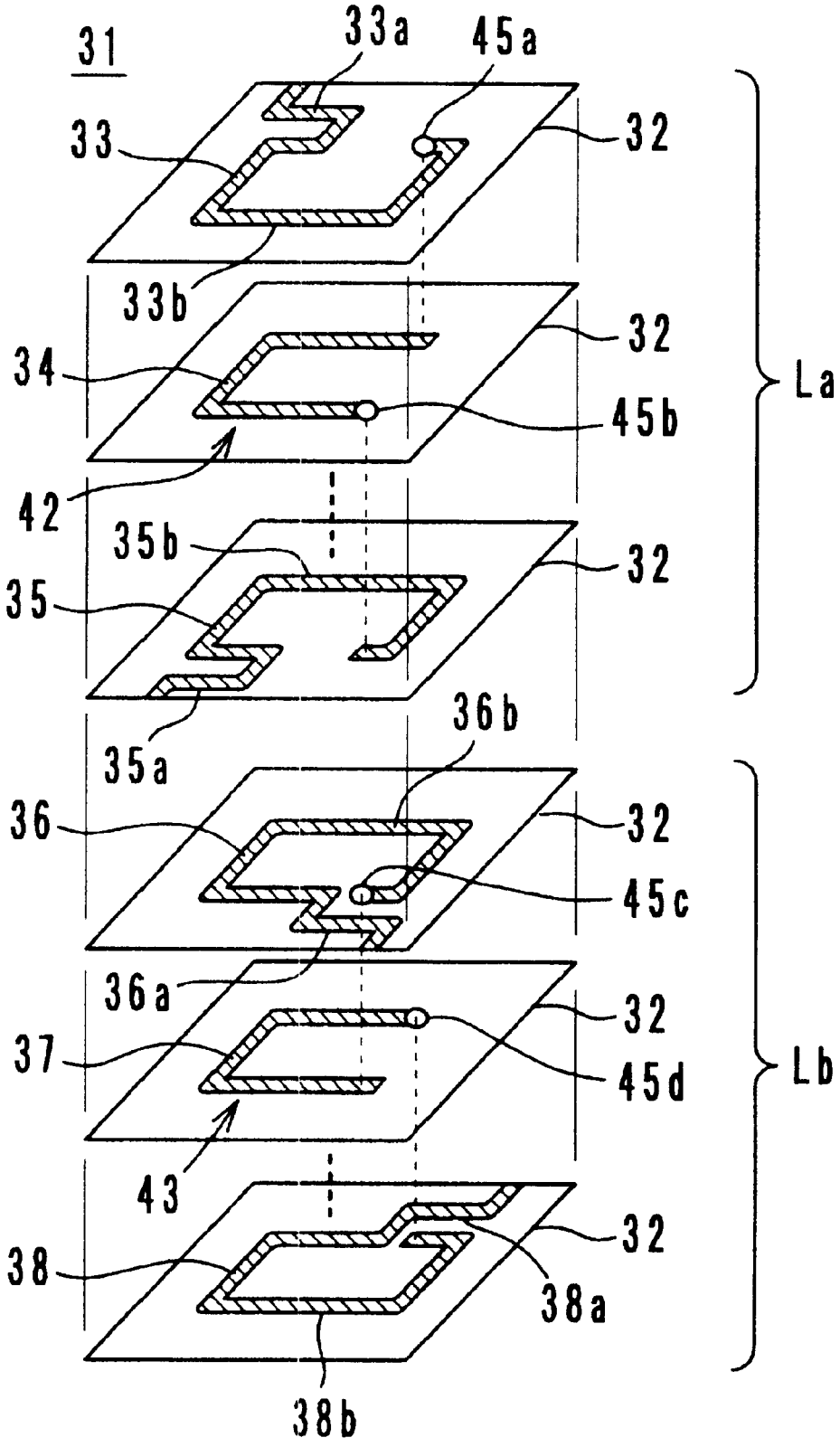
FIG. 4 is an exploded perspective view showing the configuration of a second preferred embodiment of the multilayered common-mode choke coil according to the present invention.

As shown in FIG. 4, a multilayered common-mode choke coil 31 includes insulating sheets 32 and coil conductors 33 to 38 disposed on surfaces of the insulating sheets 32. The coil conductors 33 to 35 are electrically connected in series through via-holes 45*a* and 45*b* provided in some of the insulating sheets 32 so as to define a spiral coil La having an axis which is substantially parallel to the laminating direction of the insulating sheets 32. The coil conductors 36 to 38 are electrically connected in series through via-holes 45*c* and 45*d* provided in some other insulating sheets 32 so as to define a spiral coil Lb having an axis which is substantially parallel to the laminating direction of the insulating sheets 32.

The coil conductor 33 includes an extended portion 33*a* and a coil portion 33*b*. The extended portion 33*a* extends substantially parallel to the back of one of the sheets 32. One end of the extended portion 33*a* is exposed at the left on the back of the sheet 32 and functions as an input-side extended portion of the coil La. The other end of the extended portion 33*a* is connected to the coil portion 33*b* at the left of the approximate center on the back of the sheet 32. Also, the coil conductor 35 includes an extended portion 35*a* and a coil portion 35*b*. The extended portion 35*a* extends substantially parallel to the front of one of the sheets 32. One end of the extended portion 35*a* is exposed at the left on the front of the sheet 32 and functions as an output-side extended portion of the coil La. The other end of the extended portion 35*a* is connected to the coil portion 35*b* at the left of the approximate center on the front of the sheet 32. Further, the coil portion 33*b* of the coil conductor 33, coil conductor 34, and the coil portion 35*b* of the coil conductor 35 are spirally wound by a predetermined number of times so as to define a coil portion 42 of the coil La.

The coil conductor 36 includes an extended portion 36*a* and a coil portion 36*b*. The extended portion 36*a* extends substantially parallel to the front of one of the sheets 32. One end of the extended portion 36*a* is exposed at the right on the front of the sheet 32 and functions as an output-side extended portion of the coil Lb. The other end of the extended portion 36*a* is connected to the coil portion 36*b* at the right of the approximate center on the front of the sheet 32. Also, the coil conductor 38 includes an extended portion 38*a* and a coil portion 38*b*. The extended portion 38*a* extends substantially parallel to the back of one of the sheets 32. One end of the extended portion 38*a* is exposed at the right on the back of the sheet 32 and functions as an input-side extended portion of the coil Lb. The other end of the extended portion 38*a* is connected to the coil portion 38*b* at the right of the approximate center on the back of the sheet 32. Further, the coil portion 36*b* of the coil conductor 36, the coil conductor 37, and the coil portion 38*b* of the coil conductor 38 are spirally wound by a predetermined number of times so as to define a coil portion 43 of the coil Lb.

Figure 5:
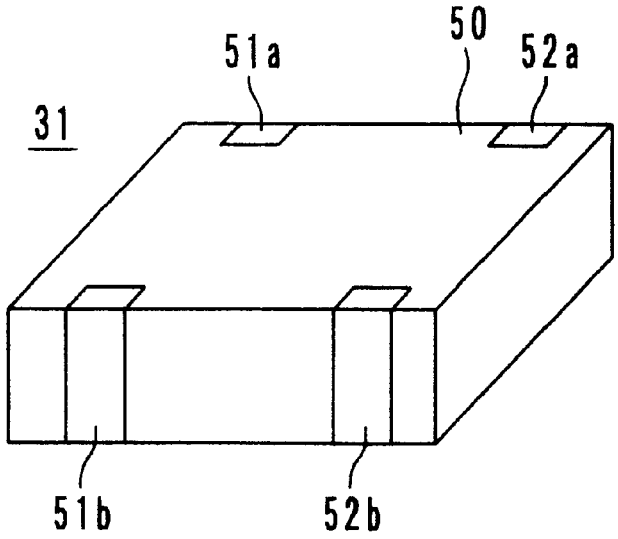
FIG. 5 is a perspective view of the multilayered common-mode choke coil shown in FIG. 4.

Each of the insulating sheets 32 is laminated, a protective insulating sheet is located on the upper and lower surfaces of each of the insulating sheets 32, and then the laminated sheets 32 are integrally baked. Accordingly, a laminated body 50 shown in FIG. 5 is produced. An input electrode 51*a* of the coil La and an input electrode 52*a* of the coil Lb are provided on the back surface of the laminated body 50. Also, an output electrode 51*b* of the coil La and an output electrode 52*b* of the coil Lb are provided on the front surface of the laminating body 50.

Figure 6:
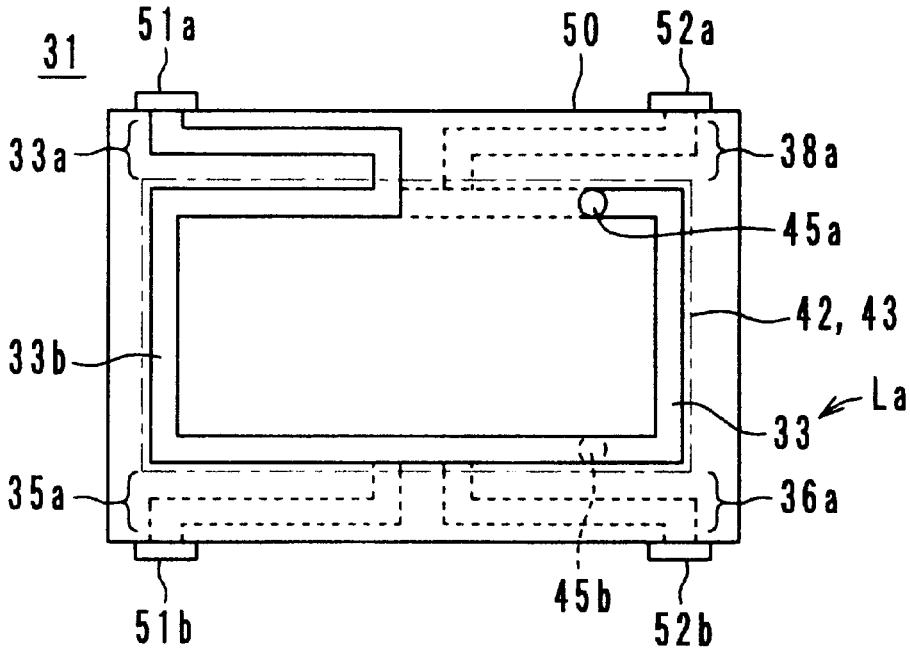
FIG. 6 is a perspective plan view of the multilayered common-mode choke coil shown in FIG. 5.

As shown in FIG. 6, the input-side extended portion 33*a* of the coil La is electrically connected to the input electrode 51*a* and the output-side extended portion 35*a* is electrically connected to the output electrode 51*b*. The input-side extended portion 38*a* of the coil Lb is electrically connected to the input electrode 52*a* and the output-side extended portion 36*a* is electrically connected to the output electrode 52*b*.

The multilayered common-mode choke coil 31 arranged in this way includes the spiral coils La and Lb, in which the diameters of the coil portions 42 and 43 are substantially equal to each other and the axes of the coil portions 42 and 43 are aligned collinearly. The spiral coils La and Lb are aligned in the laminating direction of the insulating sheets 32. Further, the magnetic coupling between the coils La and Lb is increased by aligning the axes of the coils La and Lb.

The extended portions 33*a*, 35*a*, 36*a*, and 38*a* of the coils La and Lb preferably have a flectional pattern (crank pattern) having two flections, and connect the coil portions 33*b*, 35*b*, 36*b*, and 38*b*, which are located off center in the longitudinal direction of the sheets 32, and the input/output electrodes 51*a*, 51*b*, 52*b*, and 52*a*, respectively. Also, the junction of the extended portion 33*a* and the coil portion 33*b* and the junction of the extended portion 35*a* and the coil portion 35*b* have a folded configuration. Accordingly, the number of turns and the line length of the coil La are substantially equal to those of the coil Lb so that a difference in delay of signal transmission between the coils La and Lb is minimized. As a result, transmission delay is prevented from occurring in a high-frequency band, and thus a balance of a transmission signal in a differential signal transmission is greatly improved.

Further, when the laminated body 50 is seen through, the junctions of the extended portions 33*a*, 35*a*, 36*a*, and 38*a* and the coil portions 33*b*, 35*b*, 36*b*, and 38*b* of the spiral coils La and Lb are out of alignment, that is, are not overlapped. Accordingly, the extended portions 33*a*, 35*a*, 36*a*, and 38*a* do not overlap, and thus a local internal stress caused at the junctions of the extended portions 33*a*, 35*a*, 36*a*, and 38*a* and the coil portions 33*b*, 35*b*, 36*b*, and 38*b* is dispersed when the laminated body 50 is baked. Therefore, breaking or cracking of the laminated body 50 is reliably prevented when the laminated body 50 is baked.

Figure 7:
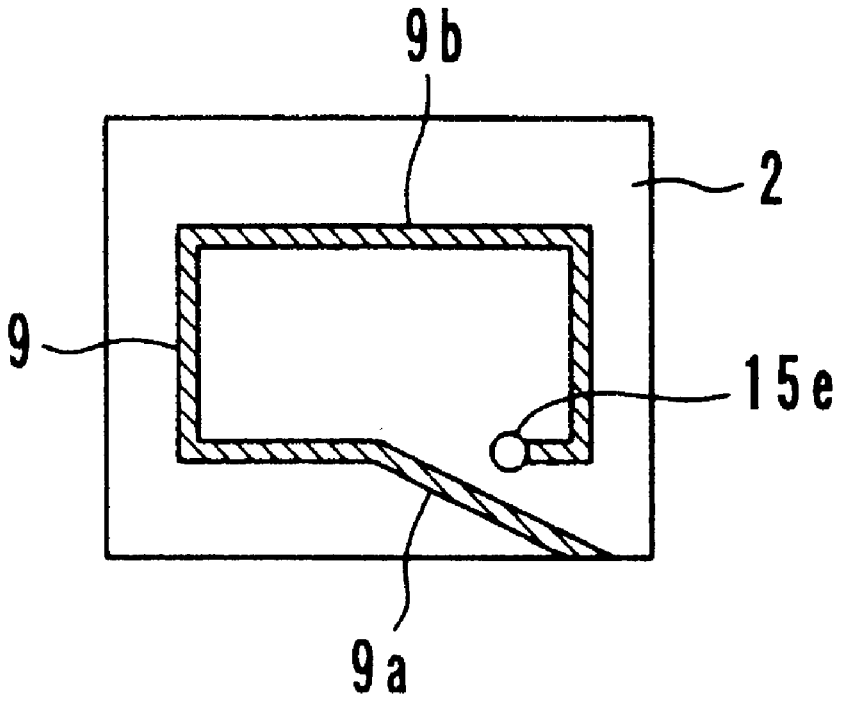
FIG. 7 is a plan view of a coil conductor according to another preferred embodiment of the present invention.
Figure 8:
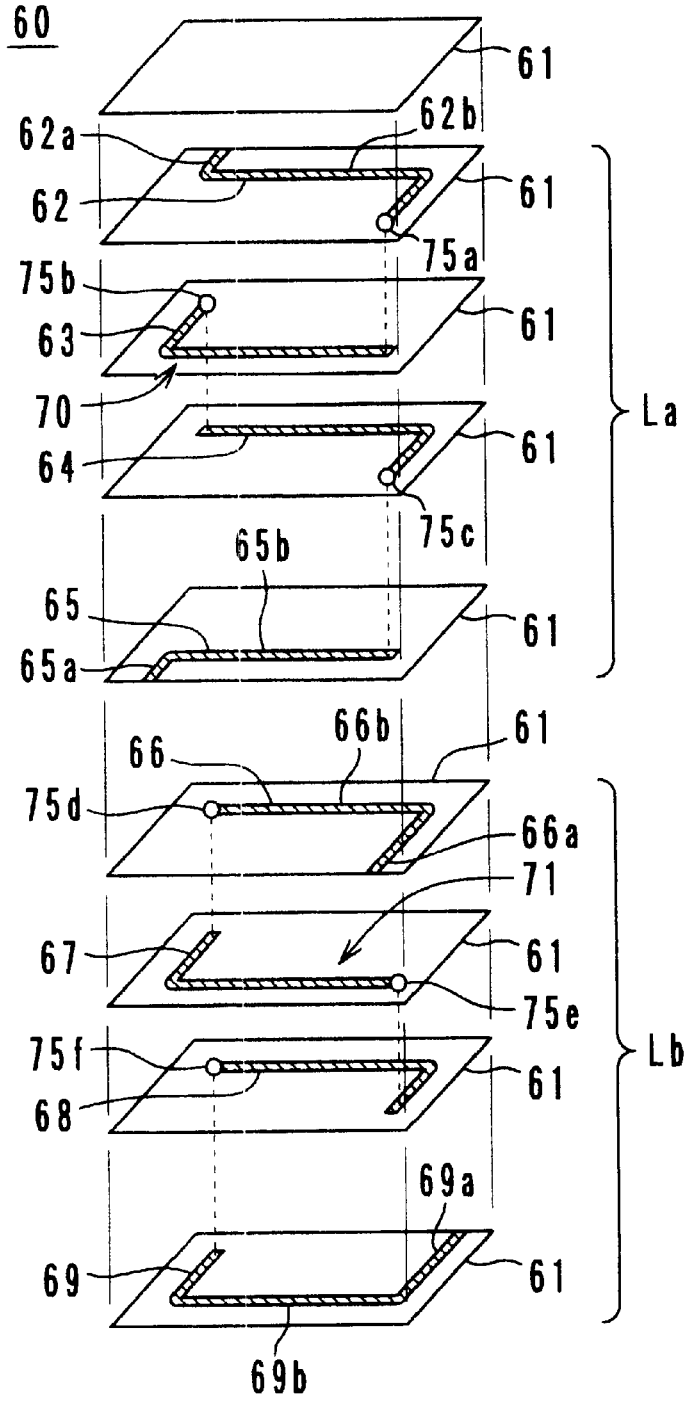
Fig. 8 PRIOR ART
FIG. 8 is an exploded perspective view showing the configuration of a known multilayered common-mode choke coil.
Figure 9:
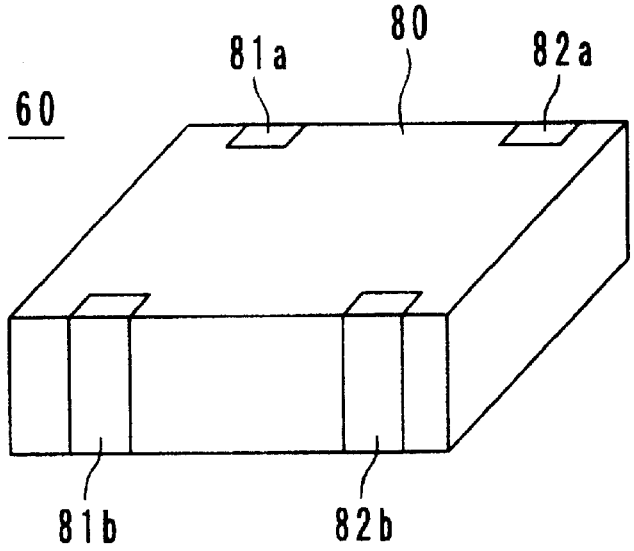
Fig. 9 PRIOR ART
FIG. 9 is a perspective view of the multilayered common-mode choke coil shown in FIG. 8.
Figure 10:
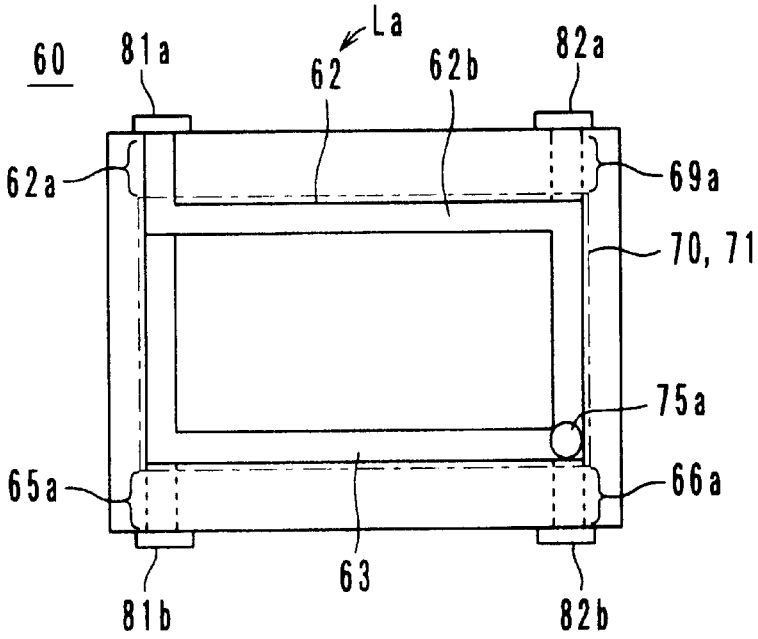
Fig. 10 PRIOR ART
FIG. 10 is a perspective plan view of the multilayered common-mode choke coil shown in FIG. 9.

The present invention is not limited to the foregoing preferred embodiments and can be modified within the scope of the present invention. For example, the extended portion of each coil conductor need not have a flectional pattern. As shown in FIG. 7, the extended portion 9*a* may linearly connect the coil portion 9*b* of the coil conductor 9, which is located at substantially the center in the longitudinal direction of the sheet 2, and the input/output electrode. In this way, by minimizing the distance between the coil portion and the external electrode, the impedance of normal-mode-components generated at the extended portion is greatly reduced.

Further, in the foregoing preferred embodiments, the insulating sheets on which conductive patterns and via-holes are formed are laminated and then are integrally baked. However, insulating sheets which are baked in advance may be used. Also, a multilayered common-mode choke coil may be manufactured with the following method. An insulating layer is formed by using an insulating paste with such a method as printing. Then, a conductive paste is applied to the surface of the insulating layer so as to form a conductor pattern and a via-hole. Then, an insulating paste is applied thereto so as to form an insulating layer. In this way, a common-mode choke coil having a multilayered structure can be obtained by overcoating.

While preferred embodiments of the invention have been described above, it is to be understood that variations and modifications will be apparent to those skilled in the art without departing the scope and spirit of the invention. The scope of the invention, therefore, is to be determined solely by the following claims.

What is claimed is:

1. A multilayered common-mode choke coil comprising:

a laminated body including a plurality of insulating layers and a plurality of coil conductors laminated together in a laminating direction; and at least two spiral coils which are defined by electrically connecting the coil conductors and which includes extended portions and coil portions;

wherein the diameters of the coil portions of said at least two spiral coils are substantially the same, the axes of the coil portions are aligned collinearly, and said at least two spiral coils are aligned in the laminating direction; and the extended portions of the at least two spiral coils are extended on the insulating layers and junctions of the extended portions and the coil portions are located at substantially the center in a predetermined direction of the insulating layers so that the lengths of the coil portions of the spiral coils are substantially equal to each other.

2. The multilayered common-mode choke coil according to claim 1, wherein at least one of the junctions of the extended portions and the coil portions has a folded configuration.

3. The multilayered common-mode choke coil according to claim 1, wherein, when the laminated body is seen through, the junctions of the extended portions and the coil portions of the plurality of spiral coils do not overlap.

4. The multilayered common-mode choke coil according to claim 1, wherein the at least two spiral coils are defined by electrically connecting the plurality of coil conductors through via-holes provided in the insulating layers, and when the laminated body is seen through, via-holes connected to the coil conductors having input-side extended portions are located at the same position and via-holes connected to the coil conductors having output-side extended portions are located at the same position.

5. The multilayered common-mode choke coil according to claim 1, wherein the plurality of coil conductors include at least one of Ag, Pd, Cu, Ni, Au, and Ag—Pd.

6. The multilayered common-mode choke coil according to claim 1, wherein each of the at least two spiral coils has a trifiler configuration.

7. The multilayered common-mode choke coil according to claim 1, wherein the extended portions of the at least two spiral coils have a flectional pattern including at least two flections.

8. The multilayered common-mode choke coil according to claim 1, wherein the number of turns and the line length of the at least two coils are substantially equal.

9. A multilayered common-mode choke coil comprising:

a laminated body including a plurality of insulating layers and a plurality of coil conductors laminated together in a laminating direction; and three spiral coils which are defined by electrically connecting the coil conductors and which includes extended portions and coil portions;

wherein the diameters of the coil portions of the three spiral coils are substantially the same, the axes of the coil portions are aligned collinearly, and the three spiral coils are aligned in the laminating direction;

one of the three spiral coils positioned at the approximate center in the laminating direction of the insulating layers is connected to a ground electrode; and two of the three spiral coils positioned at the top and the bottom in the laminating direction of the laminated body, the extended portions of the spiral coils are extended on the insulating layers and junctions of the extended portions and the coil portions are located at substantially the center in a predetermined direction of the insulating layers so that the lengths of the coil portions of the two spiral coils are substantially equal to each other.

10. The multilayered common-mode choke coil according to claim 9, wherein at least one of the junctions of the extended portions and the coil portions has a folded configuration.

11. The multilayered common-mode choke coil according to claim 9, wherein, when the laminated body is seen through, the junctions of the extended portions and the coil portions of the plurality of spiral coils do not overlap.

12. The multilayered common-mode choke coil according to claim 9, wherein the three spiral coils are defined by electrically connecting the plurality of coil conductors through via-holes provided in the insulating layers, and when the laminated body is seen through, via-holes connected to the coil conductors having input-side extended portions are located at the same position and via-holes connected to the coil conductors having output-side extended portions are located at the same position.

13. The multilayered common-mode choke coil according to claim 9, wherein the plurality of coil conductors include at least one of Ag, Pd, Cu, Ni, Au, and Ag—Pd.

14. The multilayered common-mode choke coil according to claim 9, wherein each of the three spiral coils has a trifiler configuration.

15. The multilayered common-mode choke coil according to claim 9, wherein the extended portions of the three spiral coils have a flectional pattern including at least two flections.

16. The multilayered common-mode choke coil according to claim 9, wherein the number of turns and the line length of the three coils are substantially equal.

* * * * *